United States Patent [19]

Tyner

[11] 4,194,734

[45] Mar. 25, 1980

[54] ENERGY ABSORBING BASKETBALL GOAL/BACKBOARD UNIT

[76] Inventor: Frederick C. Tyner, 2124 Hillock Dr., Raleigh, N.C. 27612

[21] Appl. No.: 917,979

[22] Filed: Jun. 22, 1978

Related U.S. Application Data

[62] Division of Ser. No. 706,836, Jul. 19, 1976, Pat. No. 4,111,420.

[51] Int. Cl.[2] ..... A63B 63/04

[52] U.S. Cl. ..... 273/1.5 R

[58] Field of Search ..... 273/1.5 R, 1.5 A; 172/264–266; 248/475 B

[56] References Cited

U.S. PATENT DOCUMENTS

| | | | |
|---|---|---|---|
| 843,993 | 2/1907 | Breen | 172/264 |
| 2,506,443 | 5/1950 | Court | 172/265 |
| 2,742,842 | 4/1956 | Redetzke | 172/264 X |
| 3,012,781 | 12/1961 | Nelson | 273/1.5 A |
| 3,098,529 | 7/1963 | Wade et al. | 172/265 |
| 3,233,898 | 2/1966 | Sheets et al. | 273/1.5 R |
| 3,795,396 | 3/1974 | Kropelnitski | 273/1.5 A X |

FOREIGN PATENT DOCUMENTS

| | | | |
|---|---|---|---|
| 604945 | 9/1960 | Canada | 172/264 |
| 1479428 | 3/1967 | France | 248/475 B |

*Primary Examiner*—Paul E. Shapiro
*Attorney, Agent, or Firm*—B. B. Olive

[57] ABSTRACT

An energy absorbing basketball goal/backboard unit incorporates a conventional vertically aligned backboard and horizontally aligned goal, i.e., the basket. The goal is spring mounted to pivot forwardly and downwardly out of its normal horizontal plane when a predetermined excess force is applied such as when a player dunks the basketball and slaps, hits or pulls the goal with his hands, wrists, or arms. The goal returns to its original position with the energy of the return motion being dissipated by shock absorbing means. In an alternate form, provision is also made for the goal to deflect sideward under spring and shock absorbing restraint.

1 Claim, 14 Drawing Figures

FIG. 1
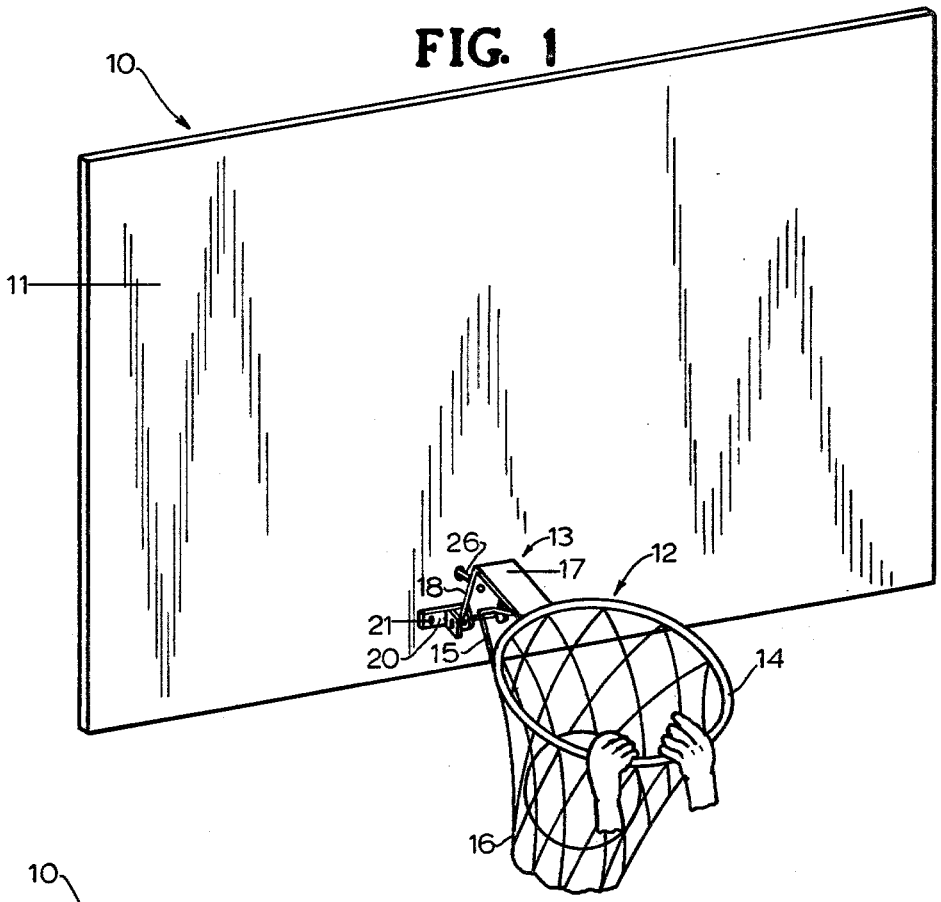
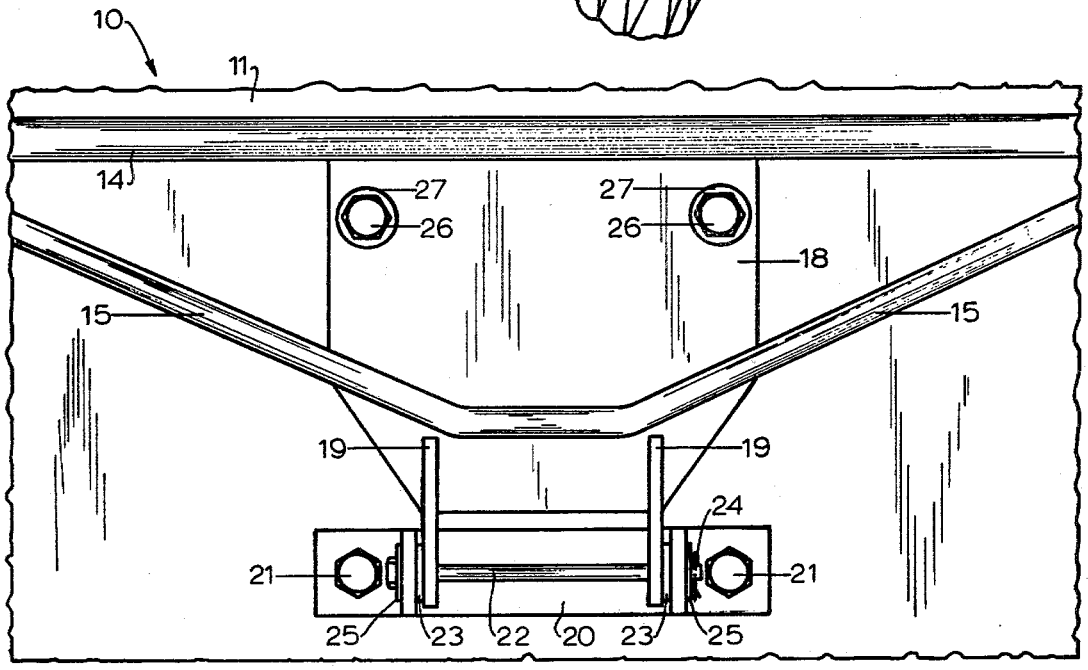
FIG. 2

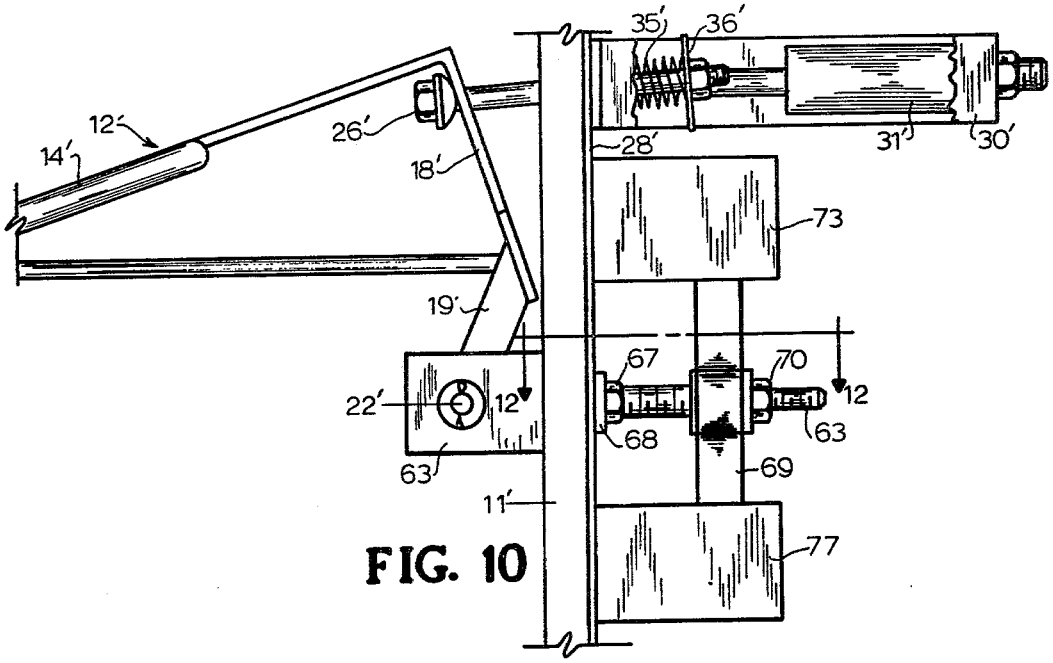
FIG. 10
FIG. 11
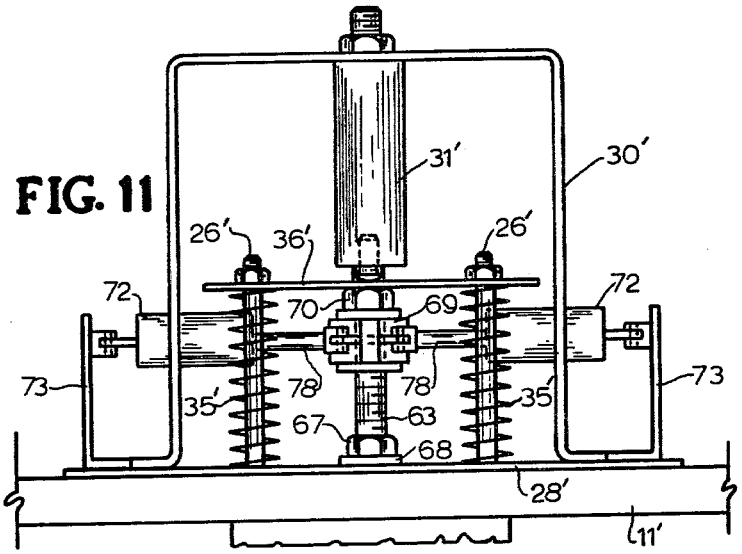
FIG. 12
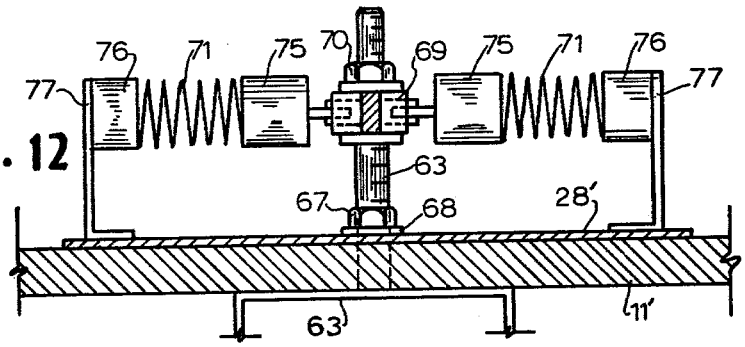

ENERGY ABSORBING BASKETBALL GOAL/BACKBOARD UNIT

CROSS-REFERENCE TO RELATED APPLICATION

This application is a voluntary divisional application of copending application Ser. No. 706,836, filed July 19, 1976, entitled "ENERGY ABSORBING BASKETBALL GOAL/BACKBOARD UNIT", now U.S. Pat. No. 4,111,420 dated Sept. 5, 1978.

BACKGROUND OF THE INVENTION

1. Field of the Invention

This invention relates to the combination of a basketball goal/backboard unit, and more particularly, to a goal/backboard unit which provides a means for absorbing shock created by the contacting of the goal by a player while dunking a basketball and thus preventing damage to the goal and backboard. Also, the likelihood of injury to the part of the player's body making contact with the goal is reduced.

2. Description of the Prior Art

In 1967, the dunk shot was banned from high school and college basketball by the associations governing the rules of play. The reasons given for the ban of the dunk shot were to prevent injuries to the players and to prevent damage to the backboard and/or goal structure.

In 1976, the rules for play of high school and college basketball were again chained to permit dunking of the basketball. However, no change was made regarding the type of backboard and goal or the manner in which they are to be mounted. Therefore, the recent rule change has not only reinstated the dunk shot, but also revived the potential for injury to the players and damage to the backboard and goal when a player dunks the ball.

Heretofore, as far as applicant can ascertain, no patents have issued relating to apparatus designed to overcome the mentioned injury and damage problems. It is to these problems that the subject invention is directed.

SUMMARY OF THE INVENTION

The energy absorbing basketball goal/backboard unit according to illustrated embodiments of the present invention incorporates a conventional vertical backboard and a basketball goal pivotally mounted on the front of the backboard. Associated compression spring/shock absorbing means are mounted behind the backboard so that the basketball goal may pivot forwardly and downwardly out of a horizontal plane when an excess downward force is applied to the goal. The force that moves the goal also stores energy in the compression spring arrangement. When the excess downward force is removed, the energy stored in the compression springs causes the goal to return to its original position. The energy of this return motion is dissipated by the shock absorbing means. Normal rebound characteristics of the ball when striking the rigidly mounted goal of the prior art will be retained in this invention by preloading the compression springs. It is only when a force in excess of the preload in the springs is applied to the goal that the goal deflects. When the player dunks the basketball, slaps, hits or pulls the goal with his hands, wrists, or arms with an excessive downward force, an associated compression spring allows the goal to pivot forwardly and downwardly and an associated shock absorber piston to extend. As the goal seeks to return to the original position, the energy stored in the compression springs will be dissipated over a time interval by the absorber and thereby prevent possible cracking, shattering, etc. of the backboard and/or damage to the goal.

The likelihood of injury to the player who strikes the goal will be reduced by the deflecting feature of the goal. The energy of the player's impact to the goal will be absorbed by the compression springs as they deflect. Because the time interval, over which the energy of the player's impact is dissipated, will be greater due to the deflection of the springs, the magnitude of the peak loads experienced by the player will be less. This deflection and the dampened return action takes place normally in a fractional part of a second and prevents a sudden impact between the goal and the backboard, but returns the goal promptly to its proper game position so as not to disrupt game play.

In an alternate embodiment, provision is made for the goal to deflect sideward and downward. Appropriate spring and shock absorbing restraint means is provided to return the goal promptly to its proper position so that game play is not disrupted.

DESCRIPTION OF THE DRAWINGS

FIG. 1 is a perspective view of a basketball goal/backboard unit constructed in accordance with and embodying the present invention and illustrating the goal in a forward and downward pivoted position as the goal is struck by a player's hands.

FIG. 2 is an enlarged, fragmentary, front elevation view of the backboard, goal and pivoting mechanism.

FIG. 10 is a side elevation view of the alternate embodiment of FIGS. 8 and 9.

FIG. 11 is a plan view of the alternate embodiment shown in FIGS. 8, 9, and 10.

FIG. 12 is a sectional view taken along line 12—12 of FIG. 10 showing the lower mounting bolt and compression springs.

DESCRIPTION OF THE PREFERRED EMBODIMENT

Figure 3:
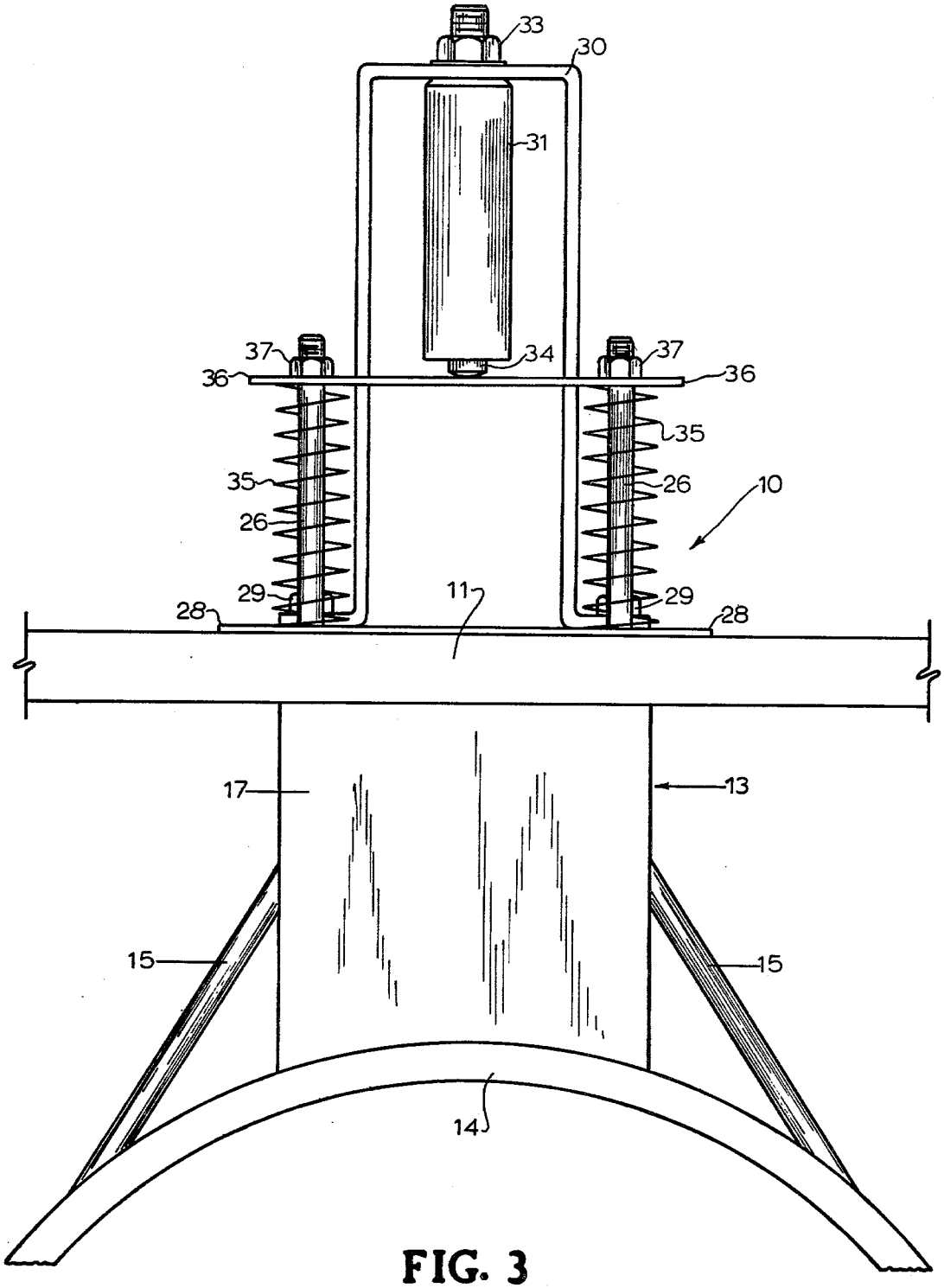
FIG. 3 is a plan view of the mechanism of FIG. 2.

Referring now to FIGS. 1 through 5, numeral 10 represents the preferred embodiment of the energy absorbing basketball goal/backboard unit of the present invention. Backboard 11 is of conventional construction and is vertically mounted by appropriate means, not shown, to meet the requirements of the rules associated therewith. The only necessary modification of the conventional backboard 11 is a slight vertical elongation of the top mounting holes for the goal 12. The elongation of these holes will permit the top mounting bolts 26 of the invention described herein to move freely when the goal 12 is deflected. The basketball goal 12, also referred to as the basket, is basically of conventional construction with slight modification to its mounting plate 13. Goal 12 is composed of ring 14, brace rods 15, net 16 suspended by net hooks (not shown) and mounting plate 13 made up of horizontal component 17 and vertical component 18. Brace rods 15 extend from ring 14 angled downwardly to vertical component 18 of mounting plate 13 and are rigidly secured as by welding.

A pair of straight members 19 are rigidly secured to vertical component 18 by welding and extend downwardly therefrom. A clevis mount 20 is secured by bolts 21 to backboard 11 so as to allow straight members 19 on component 18 to fit therebetween. Pivot pin 22 passes through each side of clevis mount 20, through washers 23, through straight members 19 and through washers 25. Pivot pin 22 is retained in the assembly by cotter pin 24 and thus permits goal 12 to pivot. Pivot pin 22 could be replaced by a bolt and nut assembly or by any other mechanisms known to those skilled in the art which would permit positive location and free rotation of straight members 19. The pivot arrangement allows for back plate 13 to pivot about pin 22 and when in a vertical position to rest flatly against backboard 11. A pair of bolts 26 pass through vertical component 18 of mounting plate 13 and have a pair of hemi-spherical washers 27 beneath the head portions thereof to prevent complete passage through component 18 and to allow free movement between the surfaces of bolts 26 and mounting plate 13.

Figure 4:
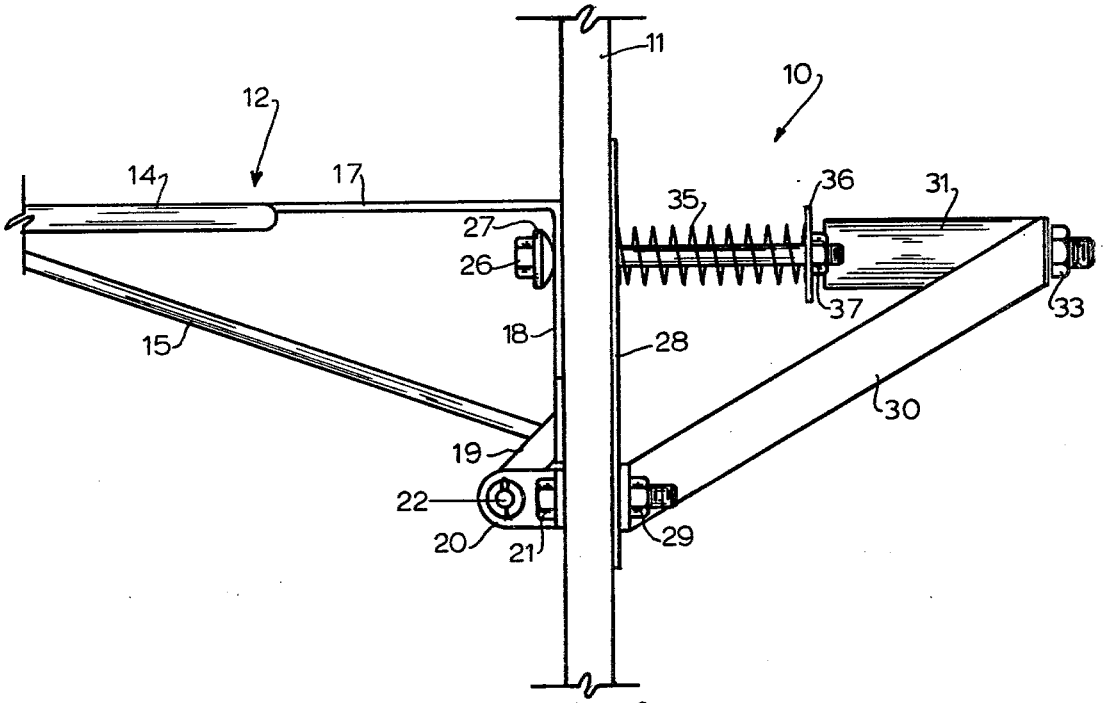
FIG. 4 is a side elevation view at a reduced scale of the mechanism of FIGS. 2 and 3 with the goal in its normal position for game play.
Figure 5:
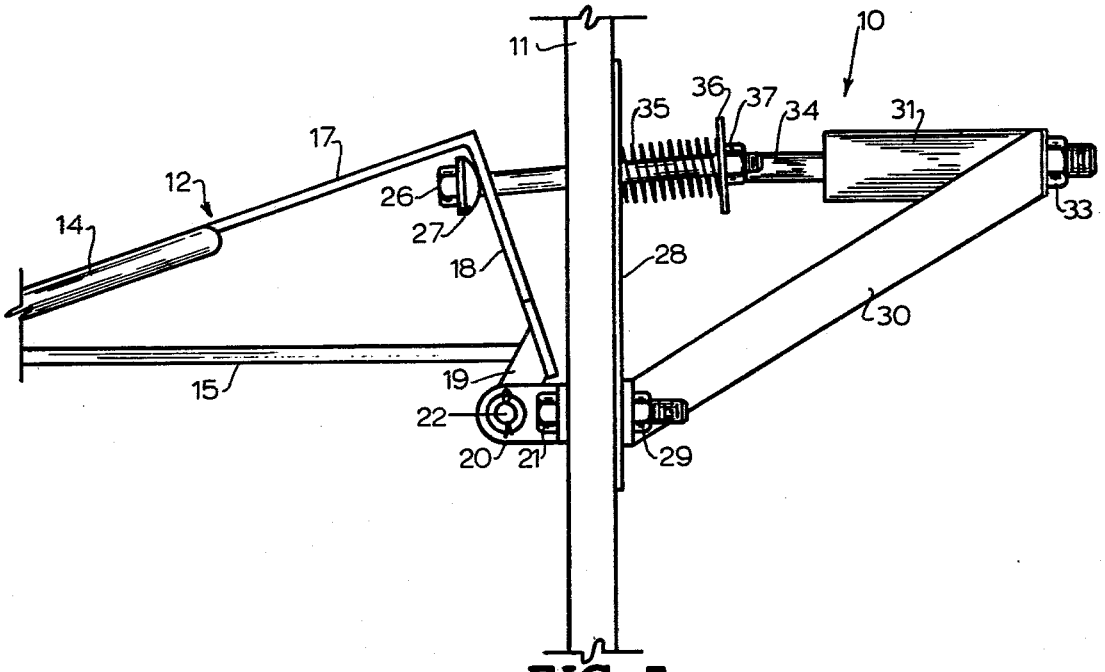
FIG. 5 is a view similar to that of FIG. 4 and illustrating the mechanism in a forward and downward pivoted position as the goal is struck by a player.

Reinforcing plate 28 is mounted against the back surface of backboard 11 and is held in place by bolts 21 and nuts 29 which mount clevis mount 20 to the front of backboard 11 and tie reinforcing plate 28 and mount 20 together in a fixed relation against and on opposite sides of backboard 11. A U-shaped support bracket 30 is mounted at its extremities on bolts 21 between plate 28 and nuts 29 and extends rearward and upward at an angle as seen in FIGS. 3, 4, and 5. Bracket 30 could also be U-shaped without the downward angle of the legs, and be welded to reinforcing plate 28 outboard of the top mounting holes. However, for clarity in illustrating the mechanism in side elevation views, bracket 30 is shown with its legs connected at bolts 21. The rear threaded end of shock absorber 31 passes through and is fixedly secured to the center portion of the U-shaped support bracket 30 by nut 33. Absorber 31 is a standard, single-acting (compression resistance) industrial type that dissipates energy such as that possessed by springs 35 as they return goal 12 to the normal position as in FIGS. 3 and 4.

As seen in FIGS. 3 through 5, bolts 26 pass through vertical component 18, backboard 11 and reinforcing plate 28 and in a slidable relation, front to rear. A pair of compression springs 35 are mounted on bolts 26 between reinforcing plate 28 and a connecting plate 36. A pair of nuts 37 retain plate 36 on bolts 26 and hold springs 35 in place and in a condition so that springs 35 tend to tension bolts 26 to maintain vertical component 18 of back plate 13 in parallel relationship with and against the front surface of backboard 11 as seen in FIG. 4. In this position, piston rod 34 is retracted and its outer end rests against connecting plate 36 as seen in FIG. 3. When ring 4 is acted on by an abnormal force as in the case of a dunk shot, goal 12 pivots forwardly and downwardly as seen in FIG. 5 and springs 35 are compressed between plates 28 and 36. Also, piston rod 34 moves outwardly under the influence of the internal force of a spring (not shown) in absorber 31 and causes the outer end of piston rod 34 to remain in contact with plate 36 as seen in FIG. 5. A suitable shield (not shown) may be attached between the heads of bolts 21 and clevis mount 20 to extend upward and adjacent to both outer edges of vertical component 18 and over the top surface of horizontal component 17. The shield remains stationary against backboard 11 to prevent entrapment of a player's hand or fingers between vertical component 18 and backboard 11 when goal 12 has been deflected away from backboard 11 as in FIG. 5.

Once the abnormal force on goal 12 is removed, the previously compressed springs 35 force rod 34 back into absorber 31 at a controlled rate until goal 12 returns to the normal position of FIG. 4. Thus, goal 12 does not impact or "slam" against backboard 11. This tilt and controlled return action may take place in a fractional part of a second with an appropriate selection of compression springs 35 and absorber 31.

Calibration of the preload force in springs 35 can be easily accomplished by suspending a known weight from the point on ring 14 that is the most distant from backboard 11, i.e., the point on ring 14 nearest the center of the playing court. Nuts 37 are then adjusted equally to permit a predetermined deflection of goal 12 away from backboard 11 as measured at a preselected point such as the intersection of horizontal member 17 and vertical member 18. The magnitude of the known weight and the deflection of goal 12 that results from suspending the weight from the front of ring 14 will be determined by the associations which formulate the rules for the game of basketball. Freefall ball-drop tests will determine the amount of preload force in springs 35 necessary to give normal rebound characteristics to the goal 12. The preload force in the springs may, for example, have to resist the force that results from a basketball freefalling to the goal from a height of approximately 15 feet above the goal. In any case, after a standard maximum ball-drop height is decided upon by the governing associations, it will be a simple manner to determine the magnitude of the weight and the accompanying deflection of goal 12 to be used when calibrating the mechanism.

Figure 6:
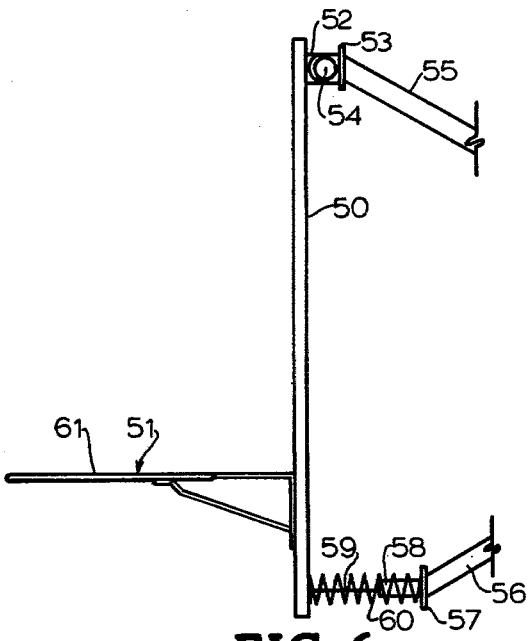
FIG. 6 is a side elevation view of an alternative embodiment of the present invention illustrating the goal in a normal position.
Figure 7:
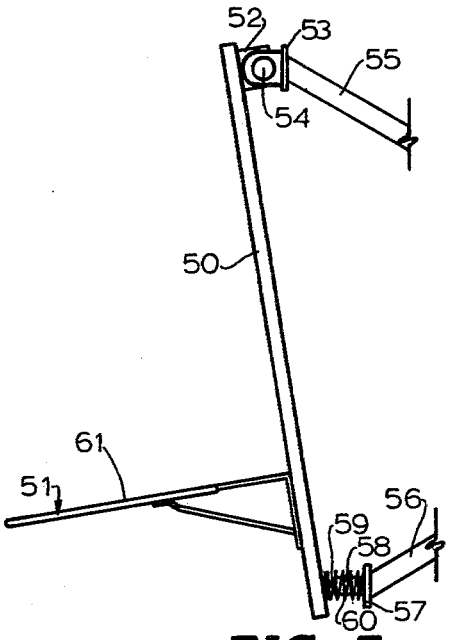
FIG. 7 is a view similar to that of FIG. 6 but illustrating the invention in a pivoted position.

An alternative embodiment of the invention is illustrated in FIGS. 6 and 7 and in which backboard 50 is of conventional construction as is basketball goal 51. Goal 51 is mounted rigidly on the front of backboard 50 in a conventional manner and according to present game rules and regulations. However, unlike conventional backboards, backboard 50 is pivotally suspended on its back surface and adjacent the top thereof by means of a pair of brackets 52 which are integrally secured to the back of backboard 50 and are adapted to mate with a pair of support brackets 53 which receive a pair of pivot pins 54 that are secured by cotter pins, not shown, or by any standard engineering method to allow backboard 50 to pivot about the respective pins 54. A pair of support arms 55 are made integral with brackets 53 and extend back to a point, not shown, where they secure to a suitable support or building wall in the manner of conventional backboards. Another pair of support arms 56 are secured to the appropriate vertical support or wall and mount a pair of brackets 57 which extend out therefrom. Arms 56 are shorter in length than arms 55 and each bracket 57 mounts integral therewith a spring-loaded shock absorber 58. Each absorber 58 has a piston rod 59 which tends to resist extension and rest against the back of backboard 50 as seen in FIG. 6. A pair of springs 60 are mounted around each shock absorber 58 and permit compression, and also return and keep backboard 50 vertical as seen in FIG. 6.

As with the mechanism of the first embodiment, once ring 61 of goal 51 is slapped or hit by a player, as in the case of a dunk shot, ring 61 is moved downward out of the horizontal plane and in turn backboard 50 is pivoted about pins 54 and the bottom of backboard 50 pivots backward as seen in FIG. 7. This action compresses springs 60. Once the force on ring 61 is removed, backboard 50 and basketball goal 51 are allowed to move back as an integral surface at their proper game position as piston rod 59 is forced outward at a controlled rate by the stored energy in springs 60.

Another alternate embodiment is illustrated in FIGS. 8 through 14. This alternate embodiment permits deflection of goal 12′ to the right or left as well as forwardly and downwardly as in the preferred embodiment. The upper compression springs 35′, plates 28′ and 36′, shock absorber 31′, etc. are essentially identical to those of the preferred embodiment except that the absorber bracket 30′ will be straight and welded to the reinforcing plate 28′ near its top instead of secured by lower mounting bolts. Also, the mounting plate 18′ is slotted on an arc 79 to permit goal 12′ to rotate to the right or left while upper mounting bolts 26′ remain stationary in the direction parallel to the face of the backboard.

Figure 8:
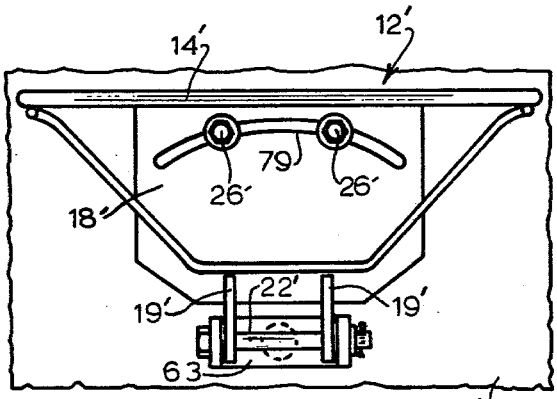
FIG. 8 is a frontal view of another alternate embodiment of the present invention illustrating the goal in a normal position.
Figure 9:
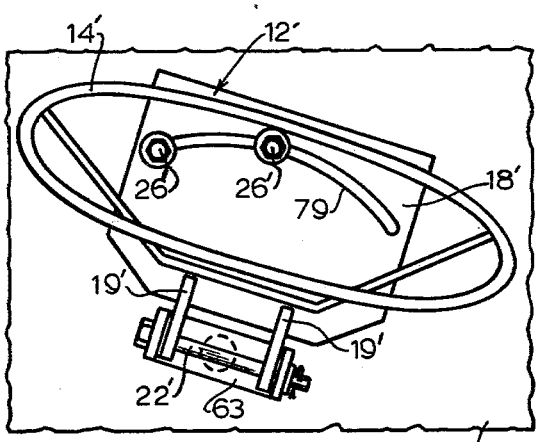
FIG. 9 is a view similar to that of FIG. 8 but illustrating the invention in a sideward and downward pivoted position.

The lower attachment means for goal 12′ consists of a single clevis head bolt 63 to which straight members 19′ are secured by a pivot pin 22′ as shown in FIGS. 8, 9 and 10. The shank of clevis head bolt 63 passes through and is secured to backboard 11′ by nut 67 beneath which is washer 68. By torquing nut 67, the proper preload can be achieved to resist normal ball forces imposed on the right or left sides of goal 12′. Lever 69 is rigidly attached to clevis head bolt 63 by a key (not shown) and nut 70. To the top arm of lever 69, absorbers 72 are attached by clevis and pin methods. The opposite ends of absorbers 72 are mounted by clevis attachments to angle clips 73 which are rigidly secured to reinforcing plate 28′.

One end of compression springs 71 fits inside of spring retaining sockets 75 in a slidable manner. One end of each spring retaining socket 75 is attached by method of clevis to lever 69. The other ends of compression springs 71 fit inside of spring retaining sockets 76 and are fixedly secured thereto. Spring retaining sockets 76 are rigidly attached to angle clips 77 which in turn are rigidly attached to reinforcing plate 28′.

Figure 13:
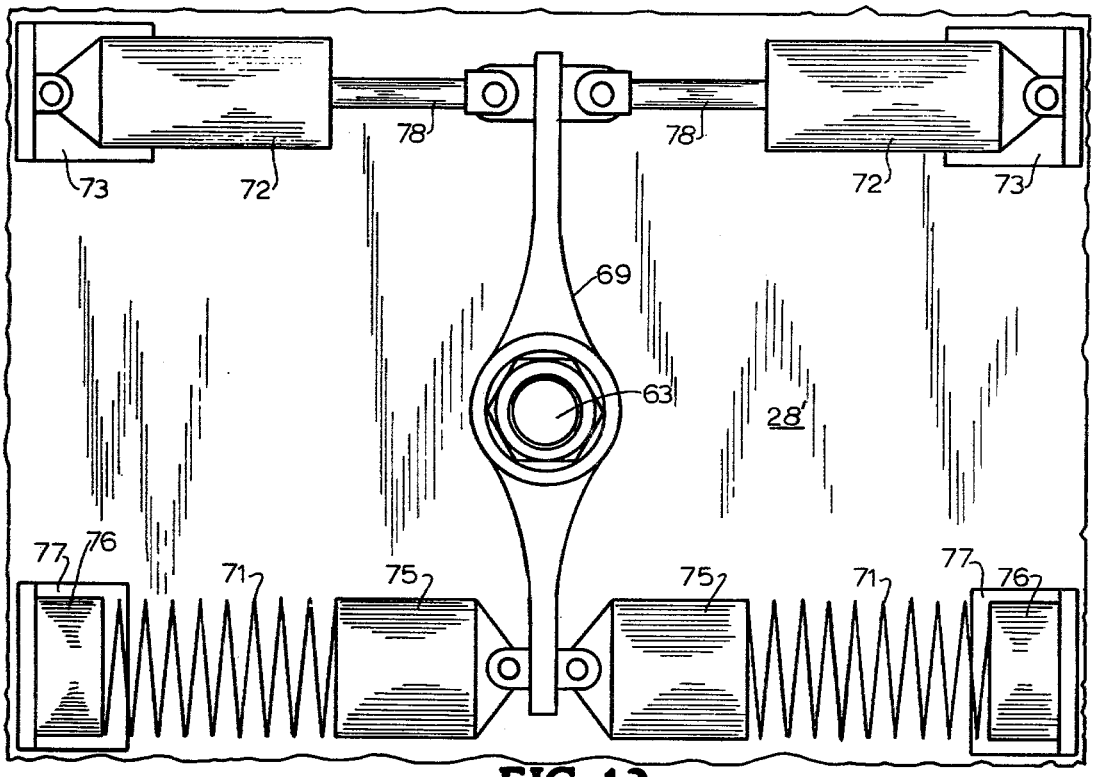
FIG. 13 is an enlarged rear elevation view of the mechanism that permits side movements of the alternate embodiment shown in FIG. 10.
Figure 14:
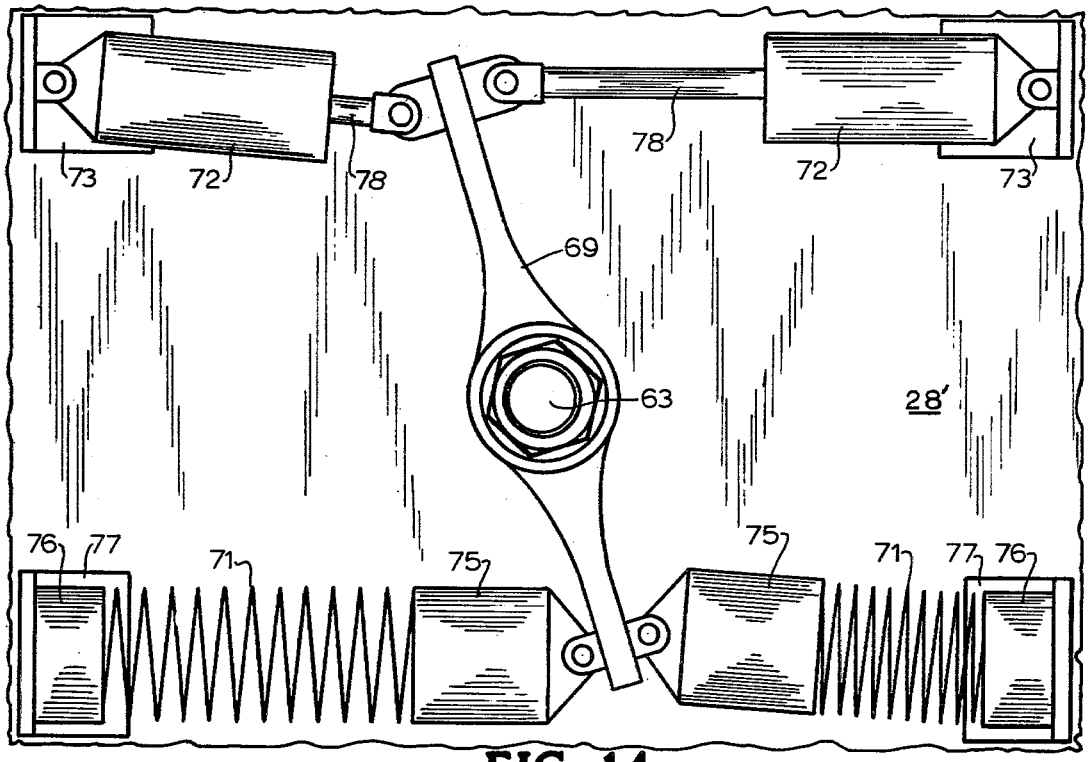
FIG. 14 is a view similar to that of FIG. 13 but illustrating the invention in a deflected position similar to that shown in FIG. 9.

FIG. 8 shows the invention in the normal position as viewed from the front and FIG. 11 shows the lower mechanism from the rear in the normal position. When the goal 12′ is deflected downward and to the right as shown by FIG. 9, the lower mechanism would assume the position as viewed from the rear in FIG. 14. The upper mechanism would deflect as described in the preferred embodiment. The valving (not shown) in absorbers 72 is arranged so that piston rods 78 resist extension forces only after piston rods 78 (left absorber) have been compressed as shown in FIG. 14. When the abnormal force has been removed from goal 12′, the compressed right spring 71 in FIG. 14 returns lever 69 to the normal position as seen in FIG. 13. Absorbers 72 offer no resistance to extension beyond the normal position shown in FIG. 13.

It should be obvious to those skilled in the art to alter the embodiments disclosed without departing from the spirit and scope of the claims. The embodiment of FIGS. 6 and 7 could, for example, utilize a single spring, piston, and bracket means for absorbing the shock therein or could be suspended by a single top support arm 55 and a single bottom support arm 56. Also, the embodiment shown in FIGS. 1 through 4 could have, for example, absorber 31 reversed and mounted directly to reinforcing plate 28 below springs 35. A pivot arm and support, also mounted to plate 28 and located below springs 35 but above absorber 31, could be connected by clevis mounts to connecting plate 36 and to absorber 31. Alternately, an extension resisting type shock absorber could be connected directly by clevis mounts to connecting plate 36 and reinforcing plate 28. There are simply a few of a number of modifications which could be made to the present invention without departing from the spirit and scope of the present invention as illustrated, described and claimed.

What is claimed is:

1. A basketball goal-backboard unit comprising, in combination:

(a) a rigidly-supported backboard having a flat vertical front surface for mounting of a goal structure thereon and having aperture means for receiving a linkage passing through said backboard and connected to said goal structure;

(b) a goal structure having an annular ring with a normal horizontal position and a mounting plate rigidly secured to and supporting said ring and having an integral depending plate portion extending downwardly and perpendicular to the plane of said ring;

(c) lower support means mounted on said backboard front surface and having a pivotal connection to said depending plate portion enabling said mounting plate and said annular ring to pivot as an integral structure about a first axis passing through said connection parallel to the plane of said ring and parallel to and proximate said backboard front surface and enabling said ring to swing between said normal horizontal position and a downwardly tilted position;

(d) upper resiliently-loaded support means including:

(i) linkage means connected to said mounting plate above said pivotal connection and extending through said aperture means formed in said backboard; and (ii) energy absorbing means mounted on the back surface of said backboard opposite said mounting plate and connected to said linkage means and being preloaded to retain said ring in said normal horizontal position until an abnormal downwardly directed force in excess of some predetermined value is applied thereto and in the event of such force to allow said ring to move out of said normal horizontal position and tilt downwardly and to be automatically returned to said normal horizontal position once said force is removed therefrom and during the return of said ring to said normal position to dissipate the energy stored in said energy absorbing means;

(e) auxiliary support means associated with said lower and upper support means and said mounting plate and permitting right left side rotation of said depending mounting plate portion around a second axis perpendicular to said first axis and permitting said depending mounting plate portion to rotate in a plane parallel to the plane of said backboard thereby allowing said ring to tilt sidewise under a said force; and (f) auxiliary energy absorbing means mounted behind the backboard for returning said depending mounting plate portion to its normal nonrotated position after such side rotation to restore said ring to its normal horizontal position and for dampening the movement of said goal structure during such return.

* * * * *

UNITED STATES PATENT OFFICE

CERTIFICATE OF CORRECTION

Patent No. 4,194,734 Dated March 25, 1980

Inventor(s) Frederick C. Tyner

It is certified that error appears in the above-identified patent and that said Letters Patent are hereby corrected as shown below:

Column 4, line 10, "4" should be --14--.

Column 5, line 26, "surface at" should be --structure to--.

Column 6, line 28, "There" should be --These--.

Column 7, line 10, "right left" should be --right-left--.

Signed and Sealed this

Second Day of September 1980

[SEAL]

Attest:

SIDNEY A. DIAMOND

Attesting Officer

Commissioner of Patents and Trademarks